US011517095B2

(12) United States Patent
Tsuyuki

(10) Patent No.: US 11,517,095 B2
(45) Date of Patent: Dec. 6, 2022

(54) PRINTING DEVICE AND PRINTING METHOD

(71) Applicant: CASIO COMPUTER CO., LTD., Tokyo (JP)

(72) Inventor: Yasuhiro Tsuyuki, Tachikawa (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 517 days.

(21) Appl. No.: 16/592,482

(22) Filed: Oct. 3, 2019

(65) Prior Publication Data

US 2020/0107628 A1 Apr. 9, 2020

(30) Foreign Application Priority Data

Oct. 4, 2018 (JP) ..... JP2018-188787

(51) Int. Cl.

| | |
|---|---|
| ***B41J 3/407*** | (2006.01) |
| ***A45D 34/04*** | (2006.01) |
| ***A45D 29/22*** | (2006.01) |
| ***B41M 5/00*** | (2006.01) |

(52) U.S. Cl.

CPC ..... *A45D 34/04* (2013.01); *A45D 29/22* (2013.01); *B41J 3/4073* (2013.01); *B41J 3/40731* (2020.08); *B41M 5/0088* (2013.01)

(58) Field of Classification Search

CPC ..... B41J 3/40731; A45D 29/22

See application file for complete search history.

(56) References Cited

U.S. PATENT DOCUMENTS

2012/0287183 A1* 11/2012 Bitoh ..... B41J 3/407 347/3

FOREIGN PATENT DOCUMENTS

| | | | | |
|---|---|---|---|---|
| CN | 107549980 | A | | 1/2018 |
| JP | 2003-534083 | A | | 11/2003 |
| JP | 2012-179320 | A | | 9/2012 |
| JP | 2012-232039 | A | | 11/2012 |
| JP | 2014023729 | A | * | 2/2014 |
| JP | 2015-054153 | A | | 3/2015 |
| JP | 2016-150092 | A | | 8/2016 |
| JP | 2018-000401 | A | | 1/2018 |

OTHER PUBLICATIONS

CNIPA; Application No. 201910910724.2; First Office Action dated Dec. 30, 2021.

JPO; Application No. 2018-188787; Notice of Reasons for Refusal dated Apr. 20, 2021.

* cited by examiner

*Primary Examiner* — Julian D Huffman

(74) *Attorney, Agent, or Firm* — Fitch. Even, Tabin & Flannery LLP

(57) ABSTRACT

A printing device including: a print head that performs printing on a printing target; a mount on which the printing target is placed; and a lift that positions a nail of a finger placed on the mount at a proper position appropriate for the printing by lifting the mount, and positions a printing medium other than the nail of the finger placed on the mount at a proper position appropriate for the printing by lifting the mount, wherein the mount includes a nail mount on which the finger or the nail is placed when the printing target is the nail of the finger and a medium mount on which the printing medium is placed when the printing target is the printing medium, and at least one of the nail mount and the medium mount is able to be attached and detached selectively according to the printing target.

7 Claims, 8 Drawing Sheets

PRINTING DEVICE AND PRINTING METHOD

CROSS-REFERENCE TO RELATED APPLICATION

This application is based upon and claims the benefit of priority from the prior Japanese Patent Application No. 2018-188787, filed on Oct. 4, 2018, the entire contents of which are incorporated herein by reference.

BACKGROUND

Technical Field

The present invention relates to a printing device and a printing method.

Background Art

There has been conventionally known a printing device (nail print device) which prints a nail design on a nail (for example, see JP 2003-534083A).

In such a printing device, a nail is set at a predetermined position, and a nail design or the like selected by a user is printed on the nail.

Such a device enables to provide nail designs to nails without using nail salons or the like.

SUMMARY

According to an aspect of the present disclosure, there is provided a printing device including: a print head that performs printing on a printing target; a mount on which the printing target is placed; and a lift that positions, as the printing target, a nail of a finger or a toe placed on the mount at a proper position appropriate for the printing by the print head by lifting the mount, and that positions, as the printing target, a printing medium other than the nail of the finger placed on the mount at a proper position appropriate for the printing by the print head by lifting the mount, wherein the mount includes a nail mount on which the finger or the nail is placed when the printing target is the nail of the finger and a medium mount on which the printing medium is placed when the printing target is the printing medium, and at least one of the nail mount and the medium mount is able to be attached and detached selectively according to the printing target.

BRIEF DESCRIPTION OF THE DRAWINGS

The accompanying drawings are not intended as a definition of the limits of the invention but illustrate embodiments of the invention, and together with the general description given above and the detailed description of the embodiments given below, serve to explain the principles of the invention, wherein.

DESCRIPTION OF EMBODIMENTS

Figure 1:
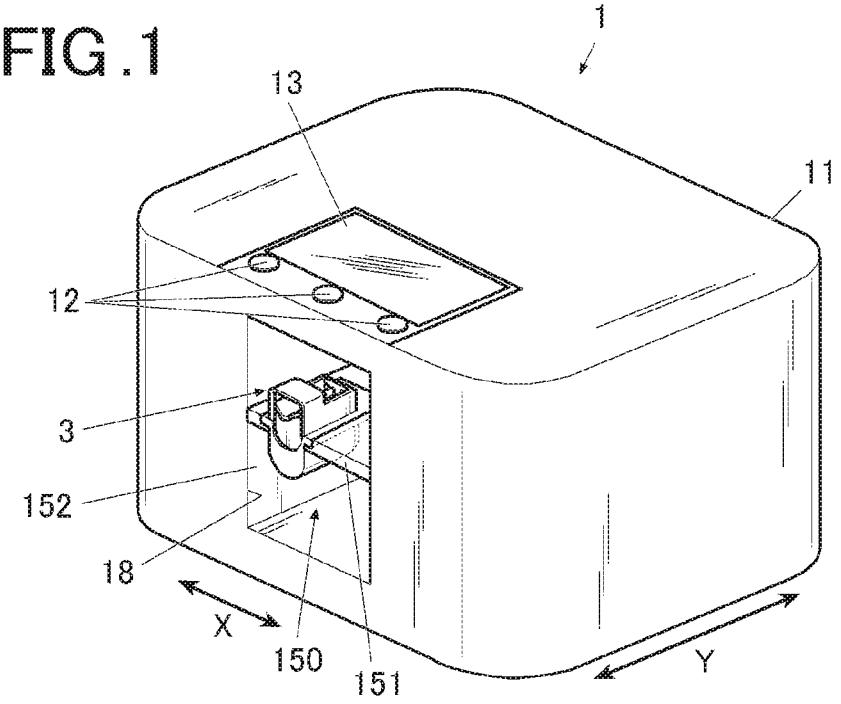
FIG. 1 is a perspective view of a nail print device which is a printing device in an embodiment.

With reference to FIGS. 1 to 13B, one embodiment of a printing device (hereinafter, referred to as a nail print device) and a printing method according to the present invention will be described.

Although various limitations which are technically preferred to implement the present invention are adopted in the following embodiment, the scope of the present invention is not limited to the following embodiment or the examples shown in the drawings.

FIG. 1 is affront view of a nail print device which is a printing device in the embodiment.

As shown in FIG. 1, the nail print device 1 in the embodiment includes a case 11 formed in an approximate box shape.

An operating unit 12 is disposed on the upper surface (top board) of the case 11.

The operating unit 12 is an input unit where a user carries out various types of inputs.

The operating unit 12 includes, for example, operating buttons for carrying out various types of inputs such as a power switch button for turning on the power of the nail print device 1, a stop switch button for stopping the operation, and a printing start button for giving an instruction to start the printing.

A display 13 is disposed on the upper surface (top board) of the case 11.

The display 13 is formed of a liquid crystal display (LCD), an organic electroluminescence display, other flat display or the like, for example.

In the embodiment, for example, various instructions, messages, and the like are displayed on the display 13 as needed.

A touch panel for performing various types of inputs may be integrally formed on the front surface of the display 13. In this case, the touch panel functions as the operating unit 12.

An insertion port 18 which is an opening for inserting a finger or the like at the time of printing by the nail print device 1 is formed on the front surface side (front side in FIG. 1) of the case 11.

In the embodiment, a target fixer 3 to be described later is moved into or out of the device through the insertion port 18 in a state in which a printing finger U1 and a nail T of the printing finger U1 (see FIG. 12B) or various types of printing mediums P (see FIGS. 13A and 13B) are fixed. Thus, the insertion port 18 is formed of a size avoiding interference when the target fixer 3 with the fixed printing finger U1 and the nail T thereof or the fixed printing medium P is inserted into or pulled out of the device.

The printing finger U1 is a finger having the nail T which is a printing target by a printer 40.

The printing medium P is a paper sheet or the like which is a printing target by the printer 40 as described later.

Figure 2:
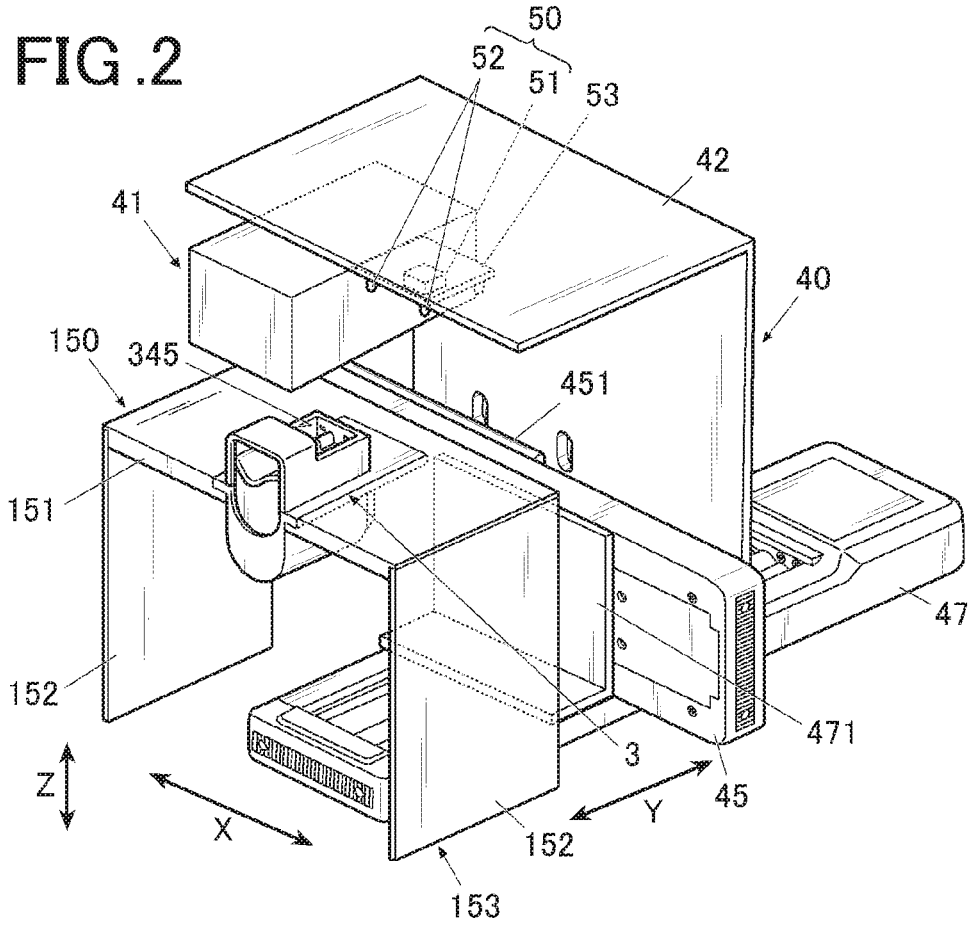
FIG. 2 is a perspective view showing the internal configuration of the nail print device shown in FIG. 1.

FIG. 2 is a main part perspective view showing the internal configuration of the nail print device 1 by removing the case 11 from the nail print device 1 shown in FIG. 1.

As shown in FIG. 2, inside the case 11, there are provided the printer 40 which performs printing on the nail T of the printing finger U1, an imaging unit 50, and a fixing positioning unit 150 which positions and fixes the printing target.

The printer 40 is configured by including a print head 41 which performs printing on the printing target, a unit supporting member 42 which supports the print head 41, an X-direction movement stage 45 for moving the print head 41 in the X direction (X direction in FIG. 1, left and right direction of the nail print device 1), an X-direction movement motor 46, a Y-direction movement stage 47 for moving the print head 41 in a Y direction (Y direction in FIG. 1, front and back direction of the nail print device 1), a Y-direction movement motor 48 and the like. In the embodiment, a head movement mechanism 49 (see FIG. 11) which moves the print head 41 is formed by the X-direction movement motor 46, the Y-direction movement motor 48 and the like.

The print head 41 in the embodiment is an inkjet head which performs printing by an inkjet method.

The print head 41 is, for example, an ink cartridge-integrated head in which ink cartridges not shown in the drawings and ink ejectors not shown in the drawings are integrally formed, the ink cartridges corresponding to the inks of yellow (Y), magenta (M), and cyan (C), and the ink ejectors being provided on the surfaces (in the embodiment, lower surfaces in FIGS. 1 and 2) facing the printing target (surface of the nail T) in the respective ink cartridges. The ink ejectors have nozzle arrays each formed of a plurality of nozzles ejecting the inks of the respective colors. The print head 41 performs printing by making the inks be micro droplets and directly spraying the inks to the surface to be printed of the printing target (nail T) from the ink ejectors. The print head 41 is not limited to the head which ejects the inks of the above three colors. The print head 41 may include ink cartridges containing other inks and ink ejectors thereof.

The unit supporting member 42 is fixed to an X-direction movement unit 451 which is attached to the X-direction movement stage 45. The X-direction movement unit 451 is moved in the X direction along a guide not shown in the drawings on the X-direction movement stage 45 by the drive of the X-direction movement motor 46. Thus, the print head 41 attached to the unit supporting member 42 is moved in the X direction (X direction in FIG. 2, left and right direction of the nail print device 1).

The X-direction movement stage 45 is fixed to a Y-direction movement unit 471 of the Y-direction movement stage 47. The Y-direction movement unit 471 is moved in the Y direction along a guide not shown in the drawings on the Y-direction movement stage 47 by the drive of the Y-direction movement motor 48. Thus, the print head 41 attached to the unit supporting member 42 is moved in the Y direction (Y direction in FIG. 2, front and back direction of the nail print device 1).

In the embodiment, the X-direction movement stage 45 and the Y-direction movement stage 47 are formed by combining the X-direction movement motor 46, the Y-direction movement motor 48, and ball screws and guides not shown in the drawings.

The print head 41, the X-direction movement motor 46, and the Y-direction movement motor 48 in the printer 40 are connected to an after-mentioned printing controller 814 (see FIG. 11) of a control device 80, and controlled by the printing controller 814.

The imaging unit 50 includes an imaging device 51 and lighting devices 52.

The imaging unit 50 is fixed to a target fixer 3 in a fixing positioning unit 150 to be described later, and lights, with the lighting devices 52, the nail T of the printing finger U1 exposed from a window 345 or the printing medium P placed on a medium mounting surface 392*a*. The imaging unit 50 photographs an image of the printing finger U1 or the printing medium P with the imaging device 51, and obtains a nail image which is an image of the nail T of the printing finger U1 (image of the finger including the nail image) or a medium image which is an image of the printing medium P.

In the embodiment, an imaging substrate 53 is fixed to the unit supporting member 42 supporting the print head 41, and the imaging device 51 and the lighting devices 52 forming the imaging unit 50 are mounted on the imaging substrate 53. The imaging unit 50 can be moved in the X-Y direction by the head movement mechanism 49 moving the unit supporting member 42.

The imaging device 51 and the lighting devices 52 are not limited to the example illustrated here as long as they are placed at the positions which can face the nail T of the printing finger U1 fixed in the target fixer 3 or the printing medium P placed on the medium mounting surface 392*a*.

For example, the imaging unit 50 may be fixed and arranged on the internal side of the top surface or the like of the case 11.

The imaging device 51 is a small-sized camera including solid state imaging elements of over two million pixels, a lens and the like, for example.

The imaging device 51 photographs an image of the nail T to obtain the nail image (image of the nail T including the printing finger U1), or photographs an image of the printing medium P to obtain the medium image. In the embodiment, on the basis of the nail image or the medium image, a printing target detector 812 to be described later detects nail information such as the outline of nail T (shape of nail T), the curved shape of nail T (curvature of nail T) and the vertical position of nail T or medium information such as the shape and the arrangement position of the printing medium P.

The lighting devices 52 are illuminating lights of white LEDs or the like, for example.

For example, two lighting devices 52 are respectively arranged on the front side and the back side of the imaging device 51 to locate the imaging device 51 between the lighting devices 52. The lighting devices 52 emit light downward to light the imaging range below the imaging device 51. The number, arrangement and the like of the lighting devices 52 are not especially limited.

The imaging unit 50 is connected to an imaging controller 811 (see FIG. 11) of the control device 80 to be described later, and controlled by the imaging controller 811.

The image data photographed by the imaging unit 50 may be stored in an after-mentioned storage 82.

The fixing positioning unit 150 includes a base 153 having an upper surface plate 151 which forms an X-Y plane facing the ink ejectors of the print head 41, and supporters 152 which support the upper surface plate 151 at a predetermined height position.

A substantially U-shaped cutout 151*b* which is open on the front side of the device is formed in the substantially central portion in the device width direction (that is, X direction in FIG. 2) in the upper surface plate 151 of the base 153.

An inward flange 151*c* (see FIGS. 3 and 4) is formed on the cutout 151*b*. As described later, the flange 151*c* functions as a guide which guides the target fixer 3 to a predetermined position in the fixing positioning unit 150.

The "predetermined position" mentioned here is the position on the X-Y plane appropriate for printing by the print head 41 of the printer 40. For example, the substantially central portion in the X and Y directions within the movable range of the print head 41 is the "predetermined position" to arrange the target fixer 3 on which the printing target (in the embodiment, the nail T of the printing finger U1 or the printing medium P other than the nail T of the printing finger U1 as described later) is placed.

Though the example of providing the flange 151*c* over the entire circumference of the U-shaped cutout 151*b* is shown in the embodiment (see FIG. 4), the range to provide the flange 151*c* is not limited to this.

For example, the flange 151*c* may be provided to only the both lateral portions in the X direction of the cutout 151*b*. The flange 151*c* may not be provided to be continuous, and may be divided into several parts and arranged.

The target fixer 3 is detachably arranged in the cutout 151*b* of the upper surface plate 151.

The target fixer 3 includes a mount on which the printing target is placed, a forcer 32 (see FIGS. 5 and 6), and the like, and fixes the printing target.

The "printing target" in the embodiment is the finger nail and the printing medium other than the finger nail.

The following description shows, as an example, a case where the fingernail is the nail T (see FIG. 12B) of the printing finger U1 which is a finger of a hand. However, the fingernail which is the printing target is not limited to the fingernail of a hand, and may be a toenail, for example.

The printing medium is, for example, a test printing sheet for performing test printing before printing on the nail T, a transferring sheet for printing a pattern or a design used as a tattoo, and sheets for various types of seals and labels. The printing medium is, for example, formed of paper or resin to which the print head 41 can perform printing. In the embodiment, a dedicated sheet which is formed of a predetermined size as the printing medium is illustrated. However, the printing medium is not limited to this, and may be in a seal form such as a nail seal used by being attached to the nail or may be an artificial nail, for example.

The target fixer 3 in the embodiment can treat both of a case where the printing target is the nail T and a case where the printing target is the printing medium P.

In detail, the target fixer 3 includes, as the mount to place the printing target, a nail mount 30 (see FIGS. 3 and 4) on which the nail T or the finger (printing finger U1) corresponding to the nail T is placed in a case where the printing target is the nail T, and a medium mounting unit 39 (in the embodiment, especially the medium mounting member 392 provided in the medium mounting unit 39, see FIGS. 9 and 10A to 10C) on which the printing medium P is placed in a case where the printing target is the printing medium P other than the nail T. The nail mount 30 and the medium mounting unit 39 can be selected according to the printing target. In the embodiment, the medium mounting unit 39 is provided as a detachable member, and the medium mounting unit 39 which includes the medium mounting member 392 is attached to the target fixer 3 and used in a case where the printing target is the printing medium P other than the nail T.

The specific configuration of the medium mounting unit 39 and the configuration to attach the medium mounting unit 39 to the target fixer 3 will be described later.

With reference to FIGS. 3 to 10C, the configuration of the target fixer 3 in the embodiment will be described in detail.

Figure 3:
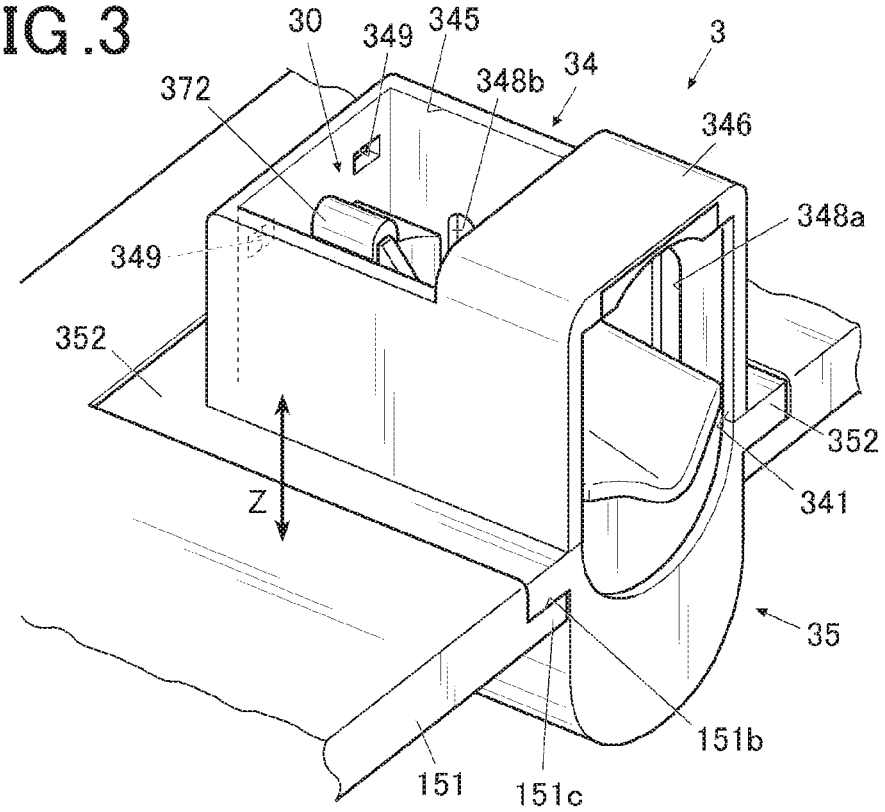
FIG. 3 is a perspective view of a target fixer in the embodiment.
Figure 4:
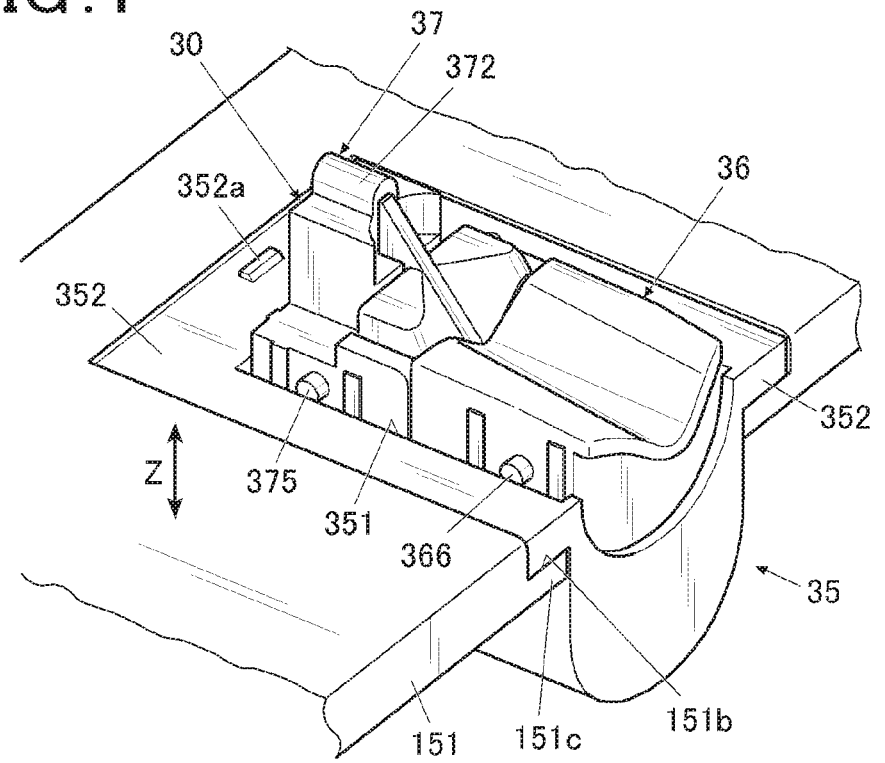
FIG. 4 is a perspective view of the target fixer showing a state in which an upper case is detached from the target fixer in FIG. 3.
Figure 5:
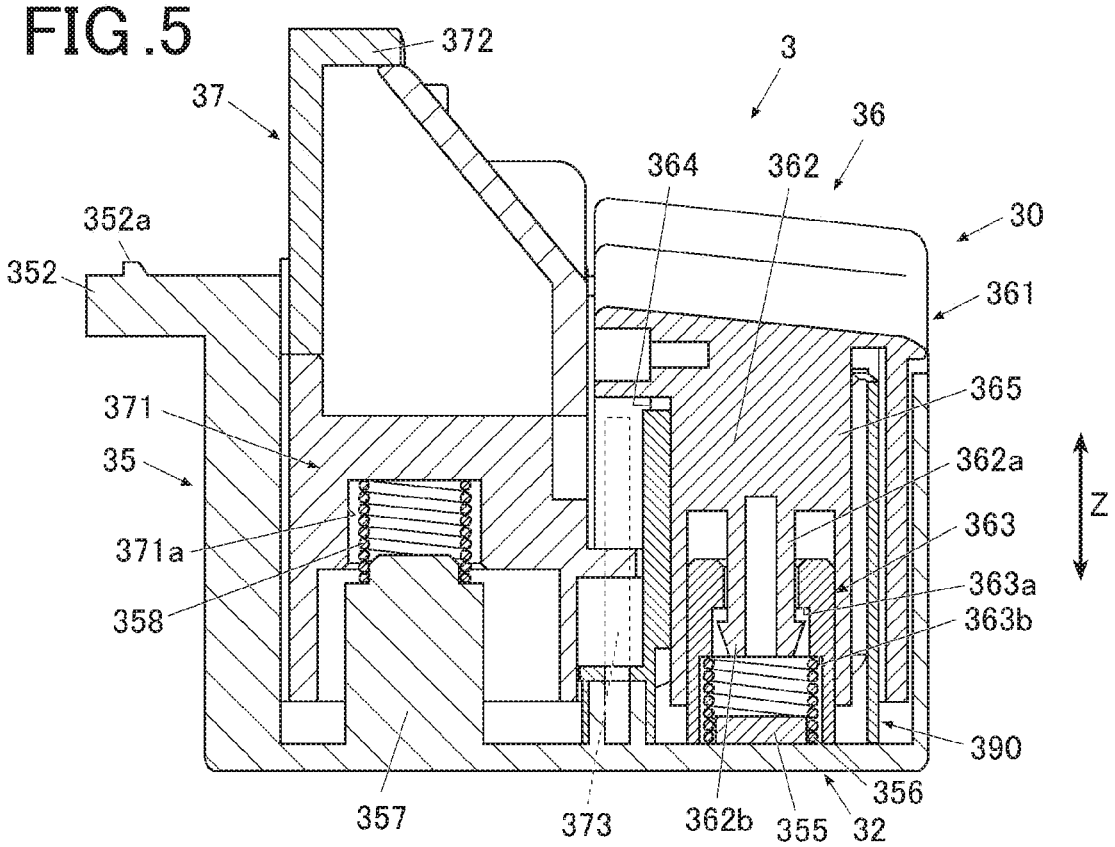
FIG. 5 is a sectional view of the target fixer in the embodiment.

FIGS. 3 and 4 are perspective views of the target fixer arranged in the cutout in the embodiment seen from an obliquely upper side. FIG. 4 is a perspective view showing the configuration of the inside by detaching the upper-side case from the state shown in FIG. 3. FIG. 5 is a lateral sectional view of the target fixer in the embodiment.

As shown in FIGS. 3 to 5, the target fixer 3 is configured by including an upper case 34 which is the case on the upper side, a lower case 35 which is a case on the lower side, the mount to place the printing target, the forcer 32 which forces the mount, and the like. The embodiment is described by showing, as an example, a case where the mount to place the nail T of the printing finger U1 as the printing target (that is, nail mount 30) is incorporated in the main body of the target fixer 3, and the mount to place the printing medium P as the printing target (that is, medium mounting unit 39) can be attached to and detached from the main body of the target fixer 3.

The upper surface side of the lower case 35 is an opening 351, and an outward flange 352 is formed along the peripheral of the opening 351. The outward flange 352 is of a size which can be placed on the flange 151*c* of the cutout 151*b*. The outward flange 352 can slide on the flange 151*c*.

The upper case 34 is open on the lower surface side, and arranged on the outward flange 352 such that the opening portion overlaps with the opening 351 of the lower case 35. As shown in FIG. 4, a fastening portion 352*a* in a form of tab is formed on one end of the outward flange 352 (in the embodiment, on the back side in the insertion direction in the target fixer 3, the end on the back surface side of the nail print device 1). A fastening receiving portion 347 to which the fastening portion 352*a* is fastened is formed at a position corresponding to the fastening portion 352*a* in the lower case (see FIG. 9). The shapes, configurations and the like of the fastening portion 352*a* and the fastening receiving portion 342 are not limited to the illustrated example as long as the upper case 34 and the lower case 35 can be fastened to each other. For example, a fastening portion in a form of tab may be formed on the upper case 34 and a fastening receiving portion to which the fastening portion is fastened may be formed on the lower case 35.

As shown in FIGS. 3 and 4, inside the space formed by the upper case 34 and the lower case 35 in the target fixer 3, the nail mount 30 to place the printing finger U1 inserted into the target fixer 3, the forcer 32 which forces the mount (nail mount 30 in the embodiment), and the like are contained.

The nail mount 30 is formed of a plurality of members which are connected to each other and arranged along the insertion direction of the printing finger U1.

In the embodiment, the nail mount 30 has two members that are a first member 36 which is arranged on the relatively front side in the insertion direction of the printing finger, and a second member 37 which is arranged in the relatively back side in the insertion direction of the printing finger.

The nail mount 30 (first member 36 and second member 37 forming the nail mount 30) is forced upward by the forcer 32.

That is, the first member 36 is forced upward by a first spring 356 which is a first forcing member, and the second member 37 is forced upward by a second spring 358 which is a second forcing member.

In the embodiment, the first spring 356 which is the first forcing member and the second spring 358 which is the second forcing member are forcing members acting on the nail mount 30, and the forcer 32 forcing the nail mount 30 is configured by including these plurality of forcing members.

Figure 6:
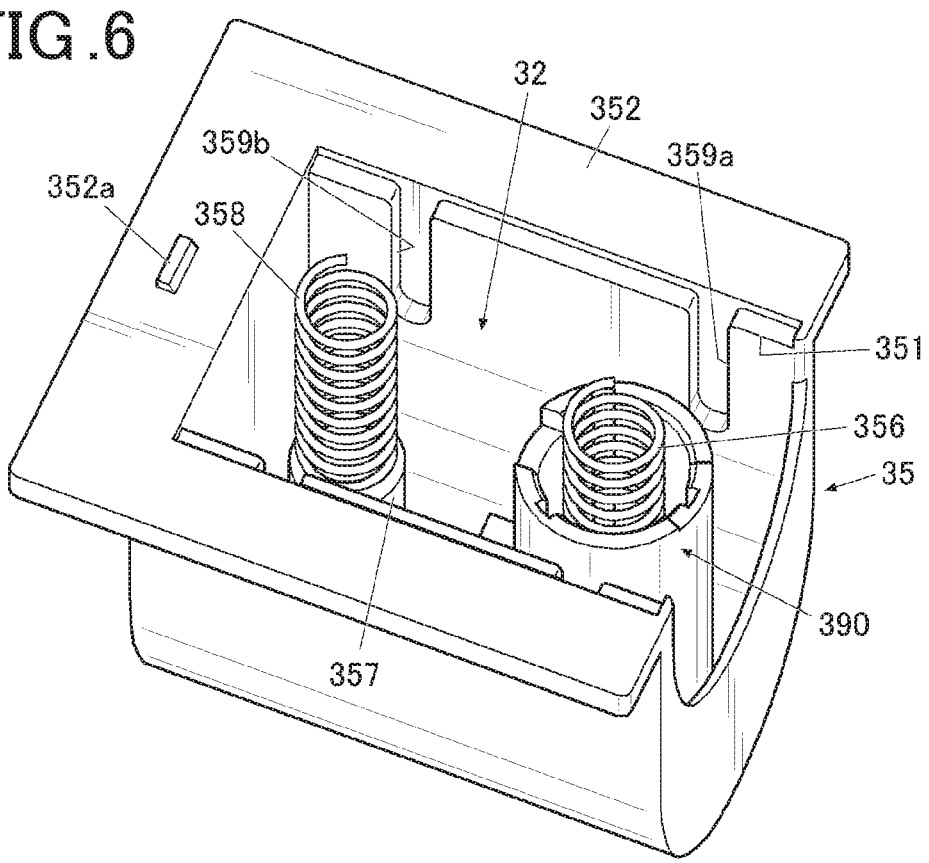
FIG. 6 is a perspective view of a lower case in the embodiment.

FIG. 6 is a perspective view of the lower case 35 seen from an obliquely upper side.

As shown in FIG. 6, a first fastening convex 355 and a second fastening convex 357 are provided to stand on the bottom surface inside the lower case 35 in the embodiment.

A base end of the first spring (first forcing member) which is the forcing member forcing the first member 36 upward is fastened to the first fastening convex 355. A base end of the second spring (second forcing member) which is the forcing member forcing the second member 37 upward is fastened to the second fastening convex 357.

As shown in FIG. 6, guide grooves 359*a* and guide grooves 359*b* are formed on both lateral surfaces inside the lower case 35, the guide grooves 359*a* guiding the first member 36 in the vertical direction when the first member 36 moves along the device height direction (vertical direction and Z direction in FIGS. 2 and 3 to 5), and the guide grooves 359*b* guiding the second member 37 along the device height direction (vertical direction and Z direction) when the second member 37 moves.

Though not shown in the drawings, guide grooves which are connected to the guide grooves 359*a* and the guide grooves 359*b* in a string when assembled and extend in the device height direction (vertical direction and Z direction) are respectively formed at the portions corresponding to the guide grooves 359*a* and 359*b* in the upper case 34.

As shown in FIG. 2, the back side in the insertion direction of the printing finger in the upper surface of the upper case 34 is a window 345 which exposes the nail T of the printing finger U1, and the front side in the insertion direction of the printing finger in the upper surface of the upper case 34 is a finger pressing portion 346 which prevents the excessive rise of the height of the printing finger U1.

In the embodiment, the state in which the nail T is exposed from the window 345 and the upper side of the printing finger U1 is located at the position (height position) abutting the lower surface of the finger pressing portion 348 corresponds to a proper position where the printing by the print head 41 of the printer 40 can be appropriately performed to the nail T which is exposed from the window 345. When the printing finger U1 and the nail T are positioned at the proper position, the tip of the nail T is placed on a nail rest 372 to be described later of the second member 37. By placing the nail T on the nail rest 372, the nail tip is prevented from moving up and down, and the state in which the printing finger U1 and the nail T are positioned at the predetermined proper position is maintained.

The shape and the configuration of the finger pressing portion 346 are not limited to the illustrated example. For example, a cushioning member or the like formed of resin may be provided to the portion abutting the upper side of the printing finger U1 in the finger pressing portion 346 (that is, surface inside the upper surface of the upper case 34). In a case where the cushioning member is provided on the surface inside the finger pressing portion 346, when the printing finger U1 is pressed up and abuts the finger pressing portion 346, a shock or a pain is not easily felt, which is preferable.

Fastening holes 349 to which fastening convex portions 391*c* of the medium mounting unit 39 to be described later are formed on the surface (surface on the left side in FIG. 3) on the back side in the insertion direction of the printing finger in the upper case 34. The positions to form the fastening holes 349 are not limited to this. The fastening holes 349 may be formed at any positions as long as the positions are corresponding to fastening convex portions 391*c* of the medium mounting unit 39, and for example, the fastening holes 349 may be provided to the outward flange 352 or the like of the lower case 35. In this case, at least the end of the medium mounting unit 39 where the fastening convex portions 391*c* are provided is formed at a height to reach the outward flange 352 of the lower case 35.

The shapes, configurations and the like of the fastening holes 349 and the fastening convex portions 391*c* are not limited to the illustrated examples as long as the medium mounting unit 39 can be fastened to the upper case 34. For example, the fastening convex portions may be formed in the upper case 34, and the fastening holes to which the fastening convex portions are fastened may be formed in the medium mounting unit 39.

Figure 7A:
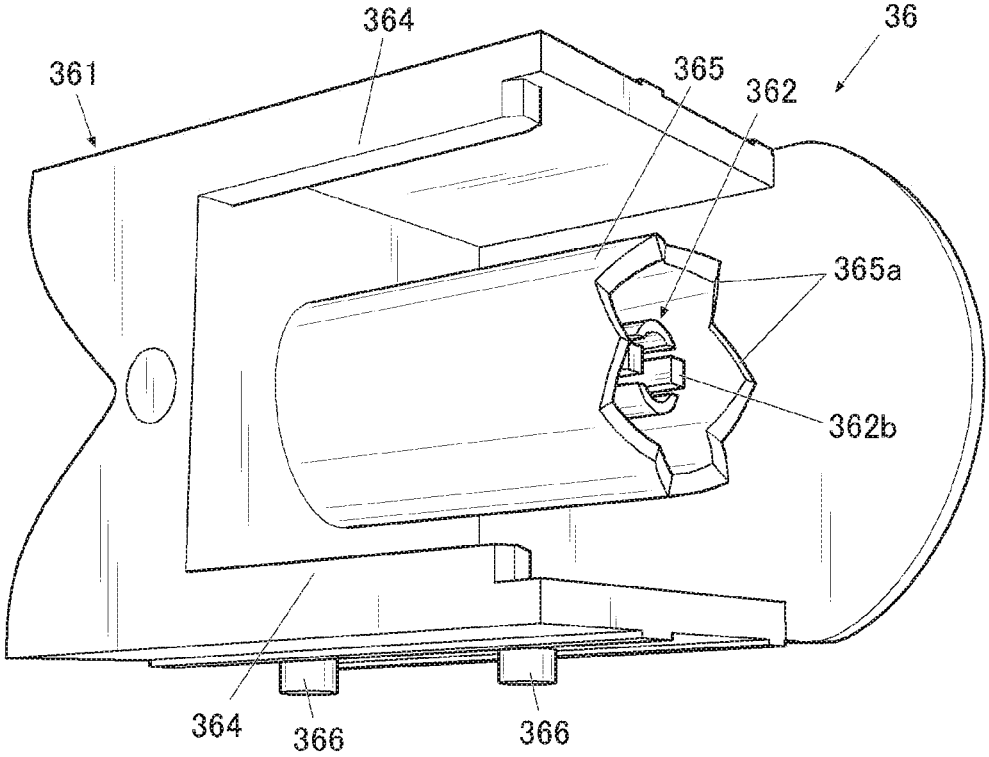
FIG. 7A is a perspective view of a first member in the embodiment, seen from an obliquely lower side.
Figure 7B:
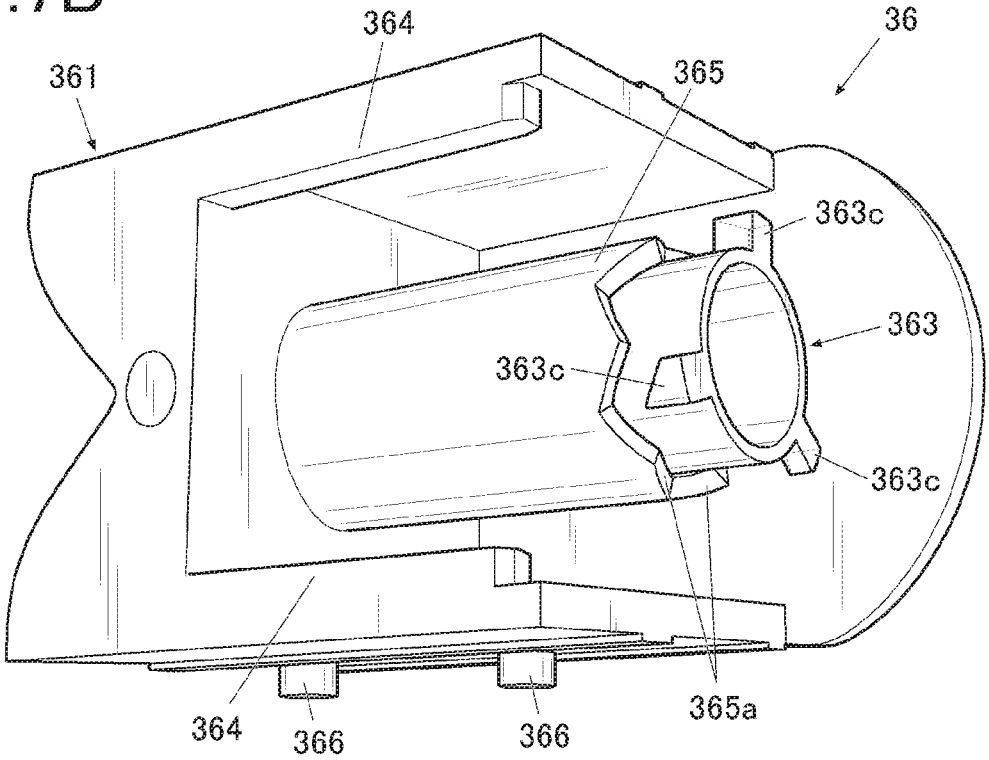
FIG. 7B is a perspective view of a state in which a rotation member is attached to the first member shown in FIG. 7A, seen from the obliquely lower side.

As shown in FIGS. 7A and 7B, guide protrusions 366 are provided at the positions corresponding to the guide grooves 359*a* of the lower case 35 and the guide grooves of the upper case 34, outside the lateral surface of the member main body 361 of the first member 36. When the first member 36 moves up and down, the guide protrusions 366 are guided to the guide grooves 359*a* of the lower case 35 and the guide grooves of the upper case 34, and smoothly moves up and down.

A pair of ribs 364 extending inside the member main body 361 are provided on the end surface on the back side (left side in FIGS. 3 to 5) in the insertion direction to the cutout 151*b* in the member main body 361 in both lateral surfaces of the member main body 361.

Engagement shafts 373 of the second member 37 to be described later are fastened to the inside of the ribs 364 inside the member main body 361. By fastening the engagement shafts 373 to the ribs 364, the first member 36 and the second member 37 are connected to each other.

In the embodiment, the forcing members forming the forcer (that is, the first spring 356 which is the first forcing member and the second spring 358 which is the second forcing member) are in a positioned state in which the printing target is positioned at the proper position when the forcing members are in a state of forcing the nail mount 30, and the forcing members are in a released state in which the positioned state is released when the forcing members are not in the state of forcing the nail mount 30.

The forcer 32 includes a locker which maintains the released state. In the embodiment, the locker maintains the released state by locking the first spring 356 which is the first forcing member forcing the first member 36.

Hereinafter, the locker in the embodiment will be described in detail.

A knock shaft 365 which is in a hollow cylindrical shape that is vertically open is provided to be hung down at the substantially central portion on the lower side (lower side in FIG. 5) of the member main body 361 of the first member 36.

As shown in FIGS. 7A and 7B, a serrated pressing portion 365*a* is formed at the opening end on the lower side of the knock shaft 365.

A fastening shaft 362 is inserted into the knock shaft 365, and fastened into the knock shaft 365 so that the fastening shaft 362 does not come off in the shaft direction.

The lower side (lower side in FIG. 5) of the fastening shaft 362 is a leg 362*a* having a spring property, and a fastening tab 362*b* is provided to the tip of the leg 362*a*.

A rotation member 363 in a cylindrical shape which is vertically open is fastened to the fastening tab 362*b* of the fastening shaft 362.

That is, as shown in FIG. 5, an inward flange 363*a* is formed on the opening of the upper side (upper side in FIG. 5) of the rotation member 363. When the leg 362*a* of the fastening shaft 362 having the spring property is inserted from the opening of the upper side, the leg 362*a* spreads inside the rotation member 363, and the fastening tab 362*b* abuts the lower side surface of the inward flange 363*a* and is fastened.

In this way, the fastening shaft 362 is fastened to the knock shaft 365 and also connected to the rotation member 363, and the fastening shaft 362 is a fastening member which fastens the knock shaft 365 to the rotation member 363. By fastening the knock shaft 365 to the rotation member 363 via the fastening shaft 362, when the rotation member 363 is fixed to a fixer 390 to be described later, the knock shaft 365 is not free and the movement in the height direction (vertical direction in FIG. 5) is regulated.

The rotation member 363 has fastening protrusions 363*c* and rotates by being pressed by the pressing portion 365*a* of the knock shaft 365.

In the embodiment, fastening protrusions 363*c* are formed at substantial intervals along the outer circumference of the rotation member 363 at the edge on the lower side (lower side in FIG. 5) of the rotation member 363. As shown in FIG. 7B, the side abutting the pressing portion 365*a* of the knock shaft 365 in the fastening protrusion 363*c* is in a shape with the end obliquely cut out to be caught in the serrated pressing portion 365*a*.

A stepped portion 363*b* is formed inside the rotation member 363. The inside diameter of the rotation member 363 is larger on the lower side of the stepped portion 363*b* than on the upper side of the stepped portion 363*b*.

In an assembled state in which the first member 36 is arranged in the lower case 35, the first spring (first forcing member) 356 is arranged inside the rotation member 363, to abut the stepped portion 363*b*. Thus, the rotation member 363 and the first member 36 fastened to the rotation member 363 via the fastening shaft 362 are forced upward by the first spring 356.

A fixer 390 is arranged at the position corresponding to the rotation member 363 on the bottom surface of the lower case 35 (see FIG. 6). The fixer 390 is a member which can be in a fastening state of fastening the fastening protrusions 363*c* of the rotation member 363 and a releasing state of releasing the fastening.

That is, a cutout not shown in the drawing for fastening the fastening protrusions 363*c* is formed on the lower end of the fixer 390.

When the fastening protrusions 363*c* move to the lower end of the fixer 390 and rotate, the fastening protrusions 363*c* are engaged in the cutout, and the movement in the height direction (vertical direction in FIG. 5) of the rotation member 363 is regulated. In the state in which the rotation member 363 is fixed to the fixer 390 in such a way, the first member 36 fastened to the rotation member 363 is also fixed to the fixer 390 via the rotation member 363 and the fastening shaft 362, and the movement of the height direction (vertical direction in FIG. 5) is regulated.

By regulating the movement of the first member 36 in the height direction, the movement in the height direction of the second member 37 fastened and connected to the first member 36 is regulated.

In the embodiment, in such a way, the knock shaft 365, the rotation member 363, and the fixer 390 form a knock cam mechanism as a locker which can regulate (lock) the movement of the nail mount 30 (in the embodiment, the first member 36 forming the nail mount 30).

The locker is not limited to the knock cam mechanism shown here as long as the movement of the nail mount 30 (in the embodiment, the first member 36) can be regulated. For example, various structures such as a heart cam mechanism can be applied as the locker.

Figure 8:
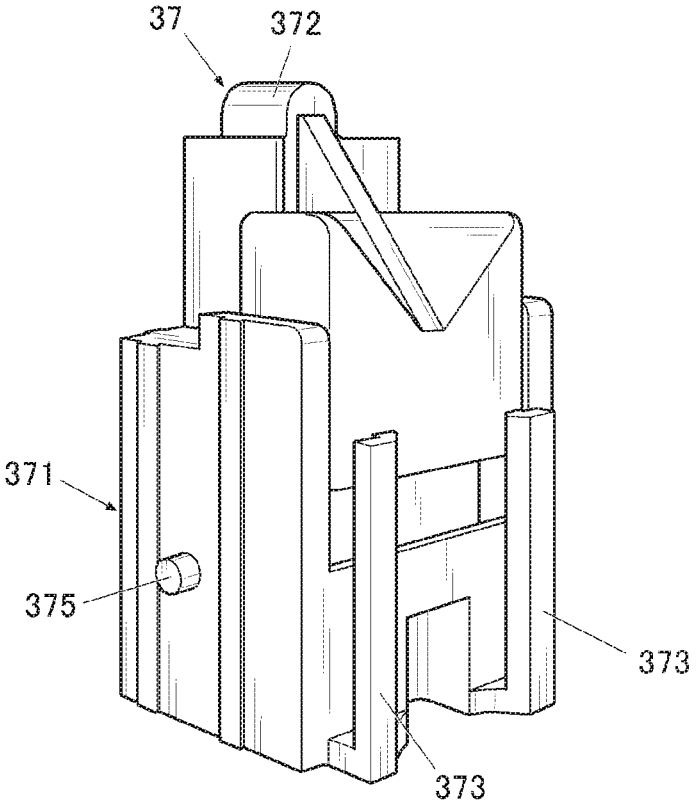
FIG. 8 is a perspective view of a second member in the embodiment.

FIG. 8 is a perspective view of the second member 37.

As shown in FIGS. 5 and 8, in the embodiment, the second member 37 includes a member main body 371 and a nail rest 372 which is provided in the upper portion of the member main body 371.

A concave 371*a* to engage the second spring (second forcing member) 358 having the base end fastened to the second fastening convex 357 is formed on the lower side (lower side in FIG. 5) of the second member 37. In the assembled state in which the second member 37 is arranged in the lower case 35, the second spring (second forcing member) 358 is arranged inside the concave 371*a*. Thus, the second member 37 is forced upward by the second spring 358.

The uppermost portion on the back side in the insertion direction of the printing finger in the second member 37 is the nail rest 372 to place the tip of the nail T when the printing finger U1 is located on the nail mount 30.

As mentioned above, the target fixer 3 in the embodiment includes a detachable medium mounting member 392 which is a medium mount on which the printing medium P is placed in addition to the nail mount 30 as the mount. In the embodiment, the target fixer 3 includes a medium mounting unit 39 for placing the printing medium P such that the medium mounting unit 39 can be attached to and detached from the main body of the target fixer 3. The medium mounting member 392 forms the medium mounting unit 39.

Figure 9:
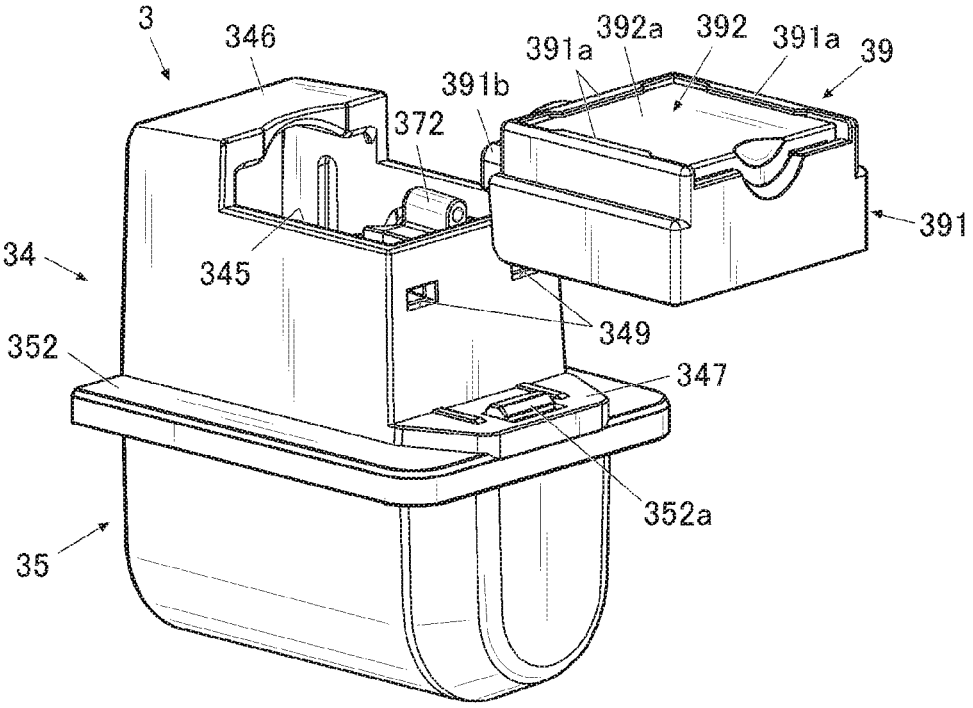
FIG. 9 is a perspective view showing how a medium mounting unit is mounted on the target fixer in the embodiment.

FIG. 9 is a perspective view showing the state of mounting the medium mounting unit 39 on the target fixer 3 in the embodiment.

As shown in FIG. 9, in the embodiment, in a case where the medium mounting unit 39 is mounted, the medium mounting unit 39 is arranged above the upper case 34 to cover the window 345 of the upper case 34 from the opposite side to the insertion direction of the printing finger.

Figure 10A:
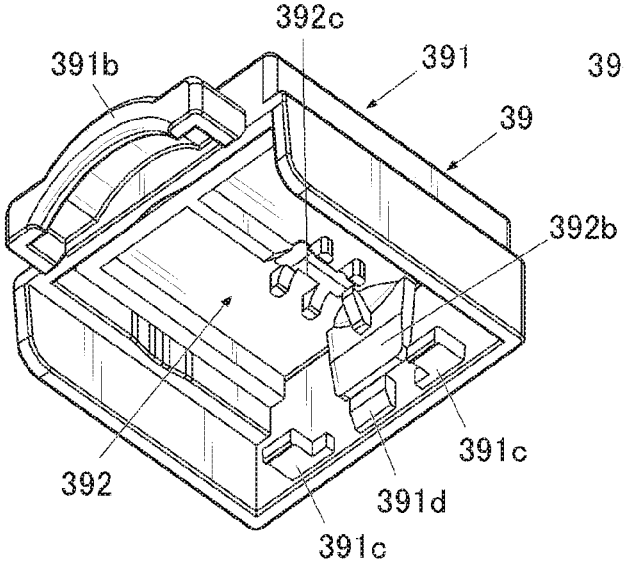
FIG. 10A is a perspective view of the medium mounting unit in the embodiment.
Figure 10B:
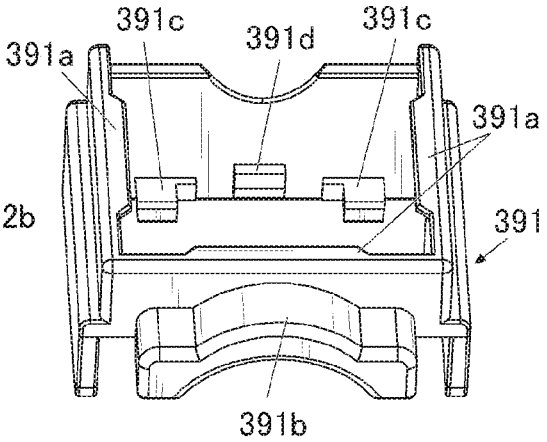
FIG. 10B is a perspective view of a unit frame forming the medium mounting unit shown in FIG. 10A.
Figure 10C:
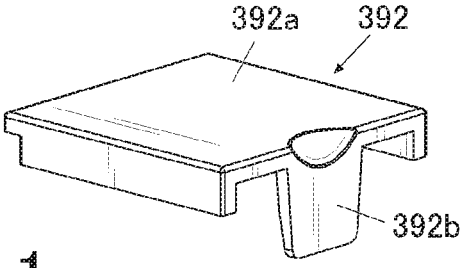
FIG. 10C is a perspective view of a medium mounting member forming the medium mounting unit shown in FIG. 10A.

FIG. 10A is a perspective view of the medium mounting unit 39 seen from the obliquely lower side. FIG. 10B is a perspective view of a unit frame 391 forming the medium mounting unit 39 seen from the obliquely upper side. FIG. 10C is a perspective view of the medium mounting member 392 forming the medium mounting unit 39.

As shown in FIGS. 9, 10A and 10B, the unit frame 391 is a frame which is open vertically (vertically in FIG. 9). The opening on the lower side is formed of a width and a length that are slightly larger than those of the window 345 of the upper case 34, and can be placed over the upper portion of the upper case 34 to cover the window 345.

Projections 391*a* projecting toward the inside from the opening end are formed in the opening on the upper side of the unit frame 391. The embodiment is described by taking, as an example, a case where the projections 391*a* are formed at the upper ends of the three lateral surfaces that are a facing surface and the surfaces on both lateral sides of the facing surface, the facing surface being the surface on the side facing the finger pressing portion 346 of the upper case 34 when the medium mounting unit 39 is mounted on the target fixer 3.

The positions, shapes, sizes and the like to form the projections 391*a* are not especially limited. It is sufficient that the projections 391*a* can regulate the position in the height direction of the printing medium P so that the position of the printing medium P placed on the medium mounting member 392 does not excessively rise, and the projections 391*a* abut the medium mounting member 392 and the printing medium P placed thereon.

For example, the projections 391*a* may be provided on any two sides or more forming the opening on the upper side of the unit frame 391. For example, the projections 391*a* may be respectively provided at the upper ends of the two facing lateral surfaces, or may be respectively provided at the upper ends of adjacent two lateral surfaces, or may be provided to the respective upper ends of all the lateral surfaces forming the unit frame 391. The projections 391*a* may be provided to respective corners forming the opening on the upper side of the unit frame 391.

The projections 391*a* may project toward the inside more greatly than the illustrated example. A plurality of divided projections may extend from a single side. The projections may be in a semicircle shape or the like.

An engagement portion 391*b* corresponding to the shape inside (lower side in FIG. 9) of the finger pressing portion 346 is provided at the position corresponding to the finger pressing portion 346 of the upper case 34 in the external lateral surface of the unit frame 391.

Fastening convex portions 391*c* are formed at the positions corresponding to the fastening holes 349 in the target fixer 3 inside the unit frame 391.

The medium mounting unit 39 is attached and fixed to the upper case 34 of the target fixer 3 by inserting the engagement portion 391*b* of the unit frame 391 into the lower side of the finger pressing portion 346 and fitting the fastening convex portions 391*c* into the fastening holes 349.

An abutting convex 391*d* is formed on the surface on which the fastening convex portions 391*c* are formed.

As shown in FIG. 10C, the medium mounting member 392 is a medium mount the upper surface of which is the medium mounting surface 392*a* on which the printing medium P is placed.

As shown in FIG. 10A, the medium mounting member 392 is arranged inside the unit frame 391. In a state in which the medium mounting member 392 is assembled to the unit frame 391, the medium mounting surface 392*a* is exposed from the opening on the upper side of the unit frame 391. By the projections 391*a* abutting the peripheral portion of the medium mounting surface 392*a*, the position in the upward direction is regulated so that the medium mounting member 392 does not come out of the opening on the upper side of the unit frame 391.

A tongue 392*b* is provided to be hung down from the edge of the medium mounting surface 392*a* at the portion corresponding to the position where the abutting convex 391*d* of the unit frame 391 is formed in the medium mounting member 392. By the tongue 392*b* abutting the abutting convex 391*d*, the medium mounting member 392 does not come off from the unit frame 391, and the position in the downward direction of the medium mounting member 392 is regulated.

As shown in FIG. 10A, a nail rest receiver 392*c* which is able to abut the upper portion of the nail rest 372 is provided inside the medium mounting member 392, that is, on the back surface side of the medium mounting surface 392*a*.

The nail rest receiver 392*c* is a claw, a concave or the like which is along the outer shape of the upper side of the nail rest 372. When the nail rest 372 abuts the back surface of the medium mounting member 392 (medium mounting surface 392*a* of the medium mounting member 392), the nail rest receiver 392*c* is fastened to the nail rest 372, to suppress the misalignment or shaking of the medium mounting member 392 with respect to the nail rest 372 and make the medium mounting member 392 stable substantially horizontally.

The medium mounting member 392 is forced to the position of abutting the projections 391*a* in a state in which the nail mount 30 formed of the first member 36 and the like are forced by the forcer 32 of the target fixer 3.

Thus, the printing medium P arranged on the medium mounting surface 392*a* is positioned at a proper position which is appropriate for printing by the print head 41.

The upper surface of the printing medium P (that is, printing surface) when the printing medium P is positioned at the proper position appropriate for the printing is located at a height position which is substantially level with the surface of the nail T (that is, printing surface) when the nail T of the printing finger U1 placed on the nail mount 30 is positioned at the proper position appropriate for the printing by the print head 41 by the forcer 32.

The control device 80 is disposed on a board or the like (not shown in the drawings) which is arranged on the under surface of the top board of the case 11, for example.

Figure 11:
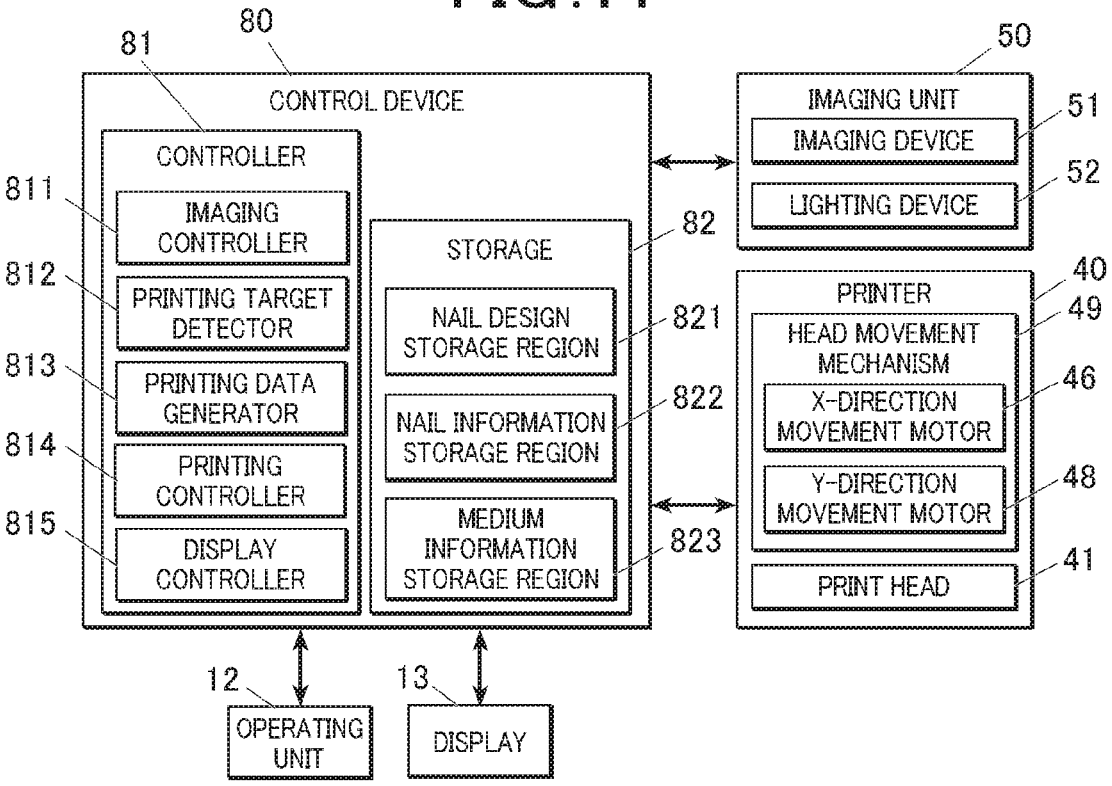
FIG. 11 is a main part block diagram showing the control configuration of a nail print device according to the embodiment.
Figure 12A:
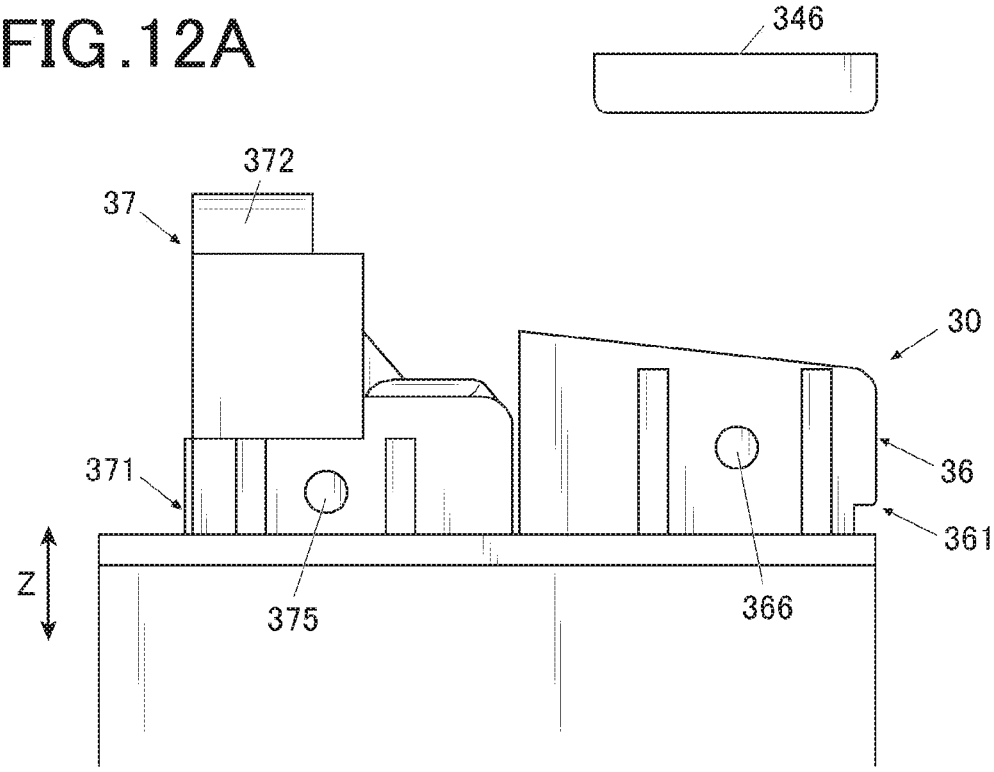
FIG. 12A is a schematic lateral view of a nail mount in a case where the target fixer is in a released state.
Figure 12B:
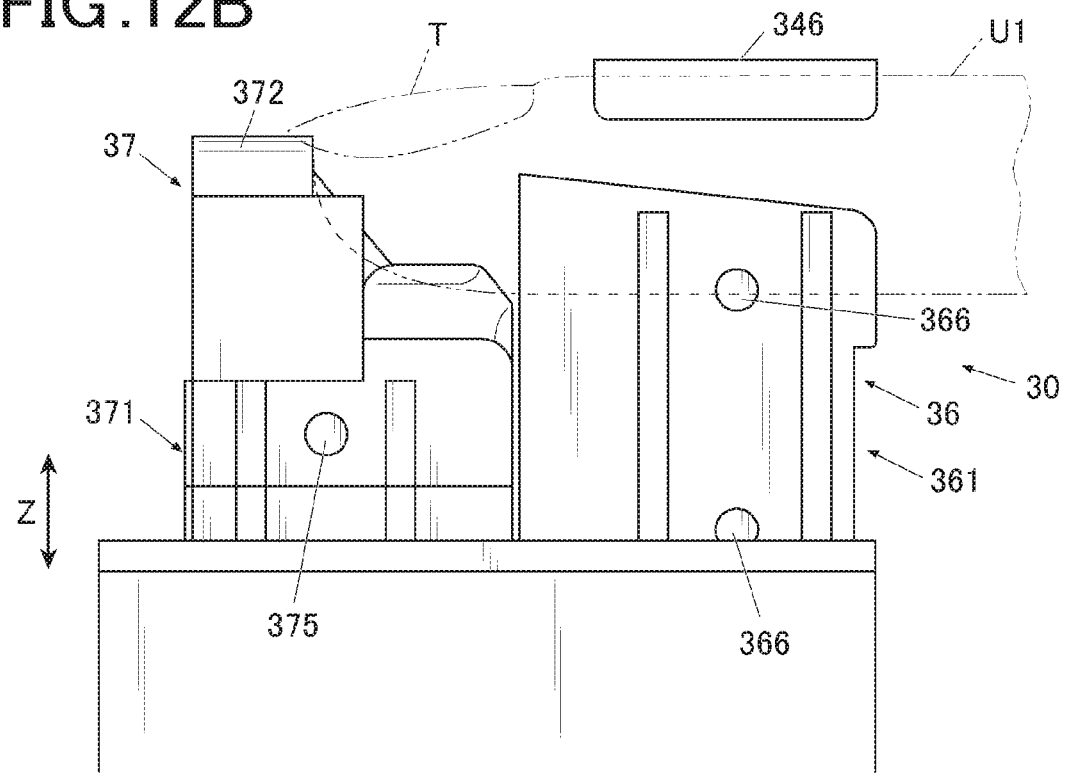
FIG. 12B is a schematic lateral view of the nail mount in a case where the target fixer is in a positioned state in which a printing finger is positioned at a proper position.

FIG. 11 is a main part block diagram showing the control configuration in the embodiment.

As shown in FIG. 11, the control device 80 is a computer including the controller 81 which is configured by including a CPU (central processing unit) not shown in the drawings, and the storage 82 configured by including a ROM (Read Only Memory), a RAM (Random Access Memory) (both not shown in the drawings) and the like.

The storage 82 stores various programs for operating the nail print device 1, various types of data and the like.

In detail, the ROM of the storage 82 stores various programs such as a printing target information detection program for detecting various types of nail information such as the shape of nail T, outline of nail T, nail width, and the position where the nail is placed from the nail image and detecting medium information such as the shape of the printing medium and the position where the printing medium is placed from the medium image obtained by photographing any of various types of printing mediums such as a transfer sheet, a printing data generation program for generating the printing data, and a printing program for performing the printing processing. These programs are executed by the control device 80, and thereby, the components of the nail print device 1 are integrally controlled.

In the embodiment, the storage 82 includes a nail design storage region 821 storing image data of the nail design printed on the nail T and the printing medium P, a nail information storage region 822 storing nail information (outline of nail T, inclination angle of nail T, and the like) detected by the printing target detector 812, a medium information storage region 823 storing the medium information (shape of the printing medium P, and the like) detected by the printing target detector 812, and the like.

In a functional view, the controller 81 includes the imaging controller 811, the printing target detector 812, the printing data generator 813, the printing controller 814, the display controller 815, and the like. The functions as the imaging controller 811, the printing target detector 812, the printing data generator 813, the printing controller 814, the display controller 815, and the like are achieved by cooperation between the CPU in the controller 81 and the programs stored in the ROM of the storage 82.

The imaging controller 811 controls the imaging device 51 and the lighting devices 52 of the imaging unit 50 to cause the imaging device 51 to photograph the image (hereinafter, referred to as "nail image") of the finger including the image of the nail T of the printing finger U1 which is fixed to the target fixer 3 and the image of the printing medium P.

The image data of the nail image and the medium image obtained by the imaging unit 50 may be stored in the storage 82.

The printing target detector 812 detects nail information regarding the nail T of the printing finger U1 on the basis of the image of the nail T (nail image) of the printing finger U1 fixed to the target fixer 3 and photographed by the imaging device 51. In a case where the image of the printing medium P (medium image) fixed to the target fixer 3 is obtained, the medium information of the printing medium P is detected on the basis of the medium image.

The nail information mentioned here is, for example, the outline of nail T (nail shape, X-Y coordinates of the horizontal position of the nail T, and the like), height of nail T (position in the vertical direction of the nail T, hereinafter, also referred to as "vertical position of nail T" or simply referred to as "position of nail T"), inclination angle (inclination angle of nail T, nail curvature) of the surface of nail T with respect to the X-Y plane, and the like.

The medium information is, for example, the shape of printing medium P, the position where the printing medium P is placed, direction in which the printing medium P is placed, the direction to which the printing medium P is directed, and the like.

As mentioned above, in the embodiment, the medium mounting surface 392*a* of the medium mounting member 392 which is the medium mount is formed with a color whose contrast with the printing medium P is clear, or the medium mounting surface 392*a* is provided with an index or the like for identifying the printing medium P.

Thus, for example, when there is a portion whose color is clearly different from the color of the medium mounting surface 392*a* that is the background, the outline and shape are extracted from the image, and the region where the printing medium P is placed can be identified.

In a case where an index indicating the outline of the printing medium P is provided in the medium mounting surface 392*a*, for example, when a part of the index cannot be detected from the image, it can be determined that the printing medium P is placed on the index and the index is covered. In this case, the outline shape and the like of the printing medium P can be detected.

Marks or the like showing the corner positions may be provided to the printing medium P, not to the medium mounting member 392. In this case, by detecting the marks from the medium image obtained by the imaging unit 50, the information on the shape and size of the printing medium P can be obtained.

In a case where an identification mark or the like (for example, barcode or various marks) indicating the type of the printing medium P is provided, the printing target detector 812 may read these identification marks from the medium image and identify the information (shape, size, thickness and the like) regarding the type of the printing medium P. The printing target detector 812 may obtain the paper quality (for example, plain paper or dedicated paper for inkjet printing), paper color and the like of the printing medium P as the medium information.

The medium information detected by the printing target detector 812 may be stored in the storage 82 or the like.

The printing data generator 813 generates printing data applied to the nail T of the printing finger U1 by the print head 41 on the basis of the nail information detected by the printing target detector 812.

In detail, the printing data generator 813 performs fitting processing of fitting image data of the nail design to the shape of nail T by enlarging, reducing, cutting or the like on the basis of the shape or the like of nail T which was detected by the printing target detector 812.

The printing data generator 813 performs curved surface correction or the like as needed in accordance with the nail information which was detected by the printing target detector 812.

Furthermore, in the embodiment, the printing data generator 813 generates printing data to be applied to the printing medium P by the print head 41 on the basis of the medium information detected by the printing target detector 812.

In detail, the printing data generator 813 performs fitting processing of fitting image data of the nail design to the shape of nail T by enlarging, reducing, cutting or the like on the basis of the shape or the like of printing medium P which was detected by the printing target detector 812.

In a case where the ink comes out differently between when the printing target is the nail T and when the printing target is the printing medium P, the printing data generator 813 may adjust the color tone and the like as needed so that the image as desired can be printed according to the printing target.

Thereby, the printing data of nail design to be printed on the printing target by the print head 41 is generated.

The printing controller 814 is a controller which outputs a control signal to the printer 40 on the basis of the printing data generated by the printing data generator 813, and controls the X-direction movement motor 46, the Y-direction movement motor 48, the print head 41 and the like of the printer 40 to perform printing according to the printing data on the nail T and the printing medium P.

The display controller 815 controls the display 13 to display various display screens on the display 13. In the embodiment, the display controller 815 causes the display 13 to display the selection screen of the nail design, thumbnail images for design confirmation, the nail image obtained by photographing the printing finger U1, the medium image obtained by photographing the printing medium P, various instruction screens, operation screens and the like, for example.

Next, the action (printing method) of the nail print device 1 in the embodiment will be described.

When printing is performed by the nail print device 1, the user first turns on the power switch to activate the control device 80.

The display controller 815 causes the display 13 to display a design selection screen. The user operates the operation buttons or the like on the operating unit 12 to select the desired nail design from among a plurality of nail designs displayed on the design selection screen. Thus, a selection instruction signal is output from the operating unit 12, and the nail design to be printed on the nail T or the printing medium P is selected.

The display controller 815 causes the display 13 to display the screen urging to select the printing target. The user operates the operation buttons on the operating unit 12, and selects whether the printing target is the nail T or the printing medium P other than the nail T. In a case where the nail T is selected as the printing target, the user may further select the finger type, that is, which finger to perform printing. In a case where the printing medium P is selected as the printing target, the user may select the type of printing medium P, the size, thickness, material (sheet made of paper, sheet made of resin or the like) or the like of the printing medium P.

In a case where the printing target is the nail T, the printing finger U1 is inserted from the insertion port 18, and the printing finger U1 and the nail T thereof are fixed to the target fixer 3. In a case where the nail T is selected as the printing target by the user, the display controller 815 may cause the display 13 to display the instruction screen urging to place the printing finger U1 and the nail T thereof on the nail mount 30 of the target fixer 3, the guide screen instructing the procedure and the like.

The user inserts the printing finger U1 and the nail T thereof from the insertion port 18 to place them on the nail mount 30 of the target fixer 3, the printing finger U1 and the nail T thereof are fixed, and the user operates the print switch not shown in the drawings on the operating unit 12.

When the printing finger U1 and the nail T thereof are fixed to the target fixer 3, in detail, the user first inserts the printing finger U1 into the target fixer 3 to the back side in the insertion direction of the printing finger in an initial set state (state shown in FIG. 12A) in which all of the members 36, 37 forming the nail mount 30 are lowered to secure the space for the user to insert the printing finger U1. At this time, the printing finger U1 is inserted to the most backward side of the second member 37 of the target fixer 3.

After the nail T of the printing finger U1 is inserted, the user once presses the nail mount 30 (member forming the nail mount 30 (in the embodiment, first member 36)) downward with the printing finger U1. Thus, the knock shaft 365 is lowered while pressing down the rotation member 363, resisting the forcing power of the first spring 356.

In the initial set state, the fastening protrusions 363*c* of the rotation member 363 are fastened to the cutout of the fixer 390 and in a locked state in which the movement in the upward direction of the rotation member 363 and the first member 36 connected thereto is regulated. By the knock shaft 365 pressing down the rotation member 363, the fastening protrusions 363*c* of the rotation member 363 are pressed to move by the inclined surface of the serrated pressing portion 365*a* of the knock shaft 365, come off from the cutout of the fixer 390, and the locked state of the fastening protrusions 363*c* is released into a state in which the fastening protrusions 363*c* can move in the vertical direction. At this time, when the user releases the pressing by the printing finger U1, the rotation member 363 and the first member 36 connected thereto are pressed upward (Z direction) by the forcing power of the first spring 356.

When the first member 36 rises, the second member 37 connected to the first member 36 rises. At this time, the guide protrusions 366 of the first member 36 are guided by the guide grooves 359*a* of the lower case 35 and the guide grooves of the upper case 34, and the guide protrusions 375 of the second member 37 are guided by the guide grooves 359*b* of the lower case 35 and the guide grooves of the upper case 34. Thus, the members of the nail mount 30 smoothly rise without misalignment.

When the upper surface of the printing finger U1 abuts the internal surface of the finger pressing portion 346, the nail mount 30 cannot rise further, and the printing finger U1 is sandwiched and fixed between the nail mount 30 and the finger pressing portion 346. At this time, the tip of the nail T is arranged on the nail rest 372, and in this state, the nail T is positioned at the proper position appropriate for printing (see FIG. 12B, nail positioning).

In such a way, in the embodiment, when the first spring 356 and the like which are the forcing members of the forcer 32 are in the state of forcing the nail mount 30, the device is in the positioned state in which the nail T of the printing finger U1 which is the printing target is positioned at the proper position.

When the printing processing to the nail T is finished, and the printing finger U1 is to be pulled out, the user again presses the nail mount 30 (in the embodiment, first member 36 forming the nail mount 30) downward with the printing finger U1. Thus, the knock shaft 365 is lowered while pressing down the rotation member 363, resisting the forcing power of the first spring 356. At this time, by the knock shaft 365 pressing down the rotation member 363, the fastening protrusions 363*c* of the rotation member 363 are pressed by the inclined surface of the serrated pressing portion 365*a* of the knock shaft 365 and moves. When the rotation member 363 is pressed down to the degree of abutting the bottom surface of the lower case 35 and the fastening protrusions 363*c* are fastened to the cutout of the fixer 390, the fastening protrusions 363*c* are in the locked state, into the initial set state (that is, the state shown in FIG. 12A).

In the embodiment, when the first spring 356 and the like which are the forcing members of the forcer 32 are not in the state of forcing the nail mount 30, the device is in the released state in which the positioned state is released.

In this state, since a sufficient space is secured between the upper surface of the nail mount 30 and the finger pressing portion 346, the user can pull out the printing finger U1 from inside the target fixer 3.

On the other hand, in a case where the printing target is the printing medium P, the user first detaches the target fixer 3 from the insertion port 18 and mounts the medium mounting unit 39 at the position covering the window 345 of the target fixer 3.

Then, the printing medium P is placed and fixed on the medium mounting surface 392*a*. When the user selects the printing medium P as the printing target, the display controller 815 may cause the display 13 to display the instruction screen urging to detach the target fixer 3 from the main body of the nail print device 1 and mount the medium mounting unit 39 on the target fixer 3 and to place the printing medium P on the medium mounting member 392 of the medium mounting unit 39, a guide screen instructing the procedure, and the like.

The user places the printing medium P on the medium mounting member 392 of the target fixer 3 to fix the printing medium P, and then operates the print switch not shown in the drawings of the operating unit 12.

When the printing medium P is fixed to the medium mounting member 392 of the medium mounting unit 39 mounted on the target fixer 3, in detail, the user first makes the target fixer 3 be in an initial set state (state shown in FIG. 13A) in which the target fixer 3 is in a locked state with all of the members 36, 37 forming the nail mount 30 lowered.

Figure 13A:
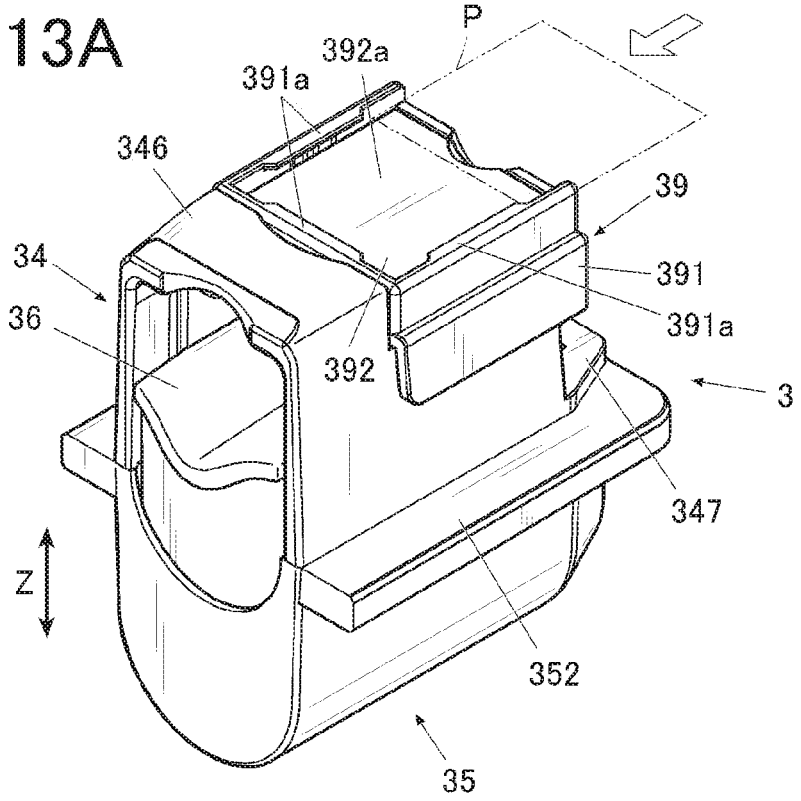
FIG. 13A is a perspective view showing how a printing medium is placed on the medium mounting unit mounted on the target fixer.

In this state, the nail rest 372 of the nail mount 30 does not abut the surface on the lower side of the medium mounting member 392 of the medium mounting unit 39, and the medium mounting member 392 is lowered to the position where the tongue 392*b* abuts the abutting convex 391*d* (see FIG. 13A).

In this state, a sufficient space is secured between the medium mounting surface 392*a* of the medium mounting member 392 and the projections 391*a* of the unit frame 391. As shown in FIG. 13A, the user places the printing medium P on the medium mounting surface 392*a* in this state.

When the printing medium P is placed, the user once presses the nail mount 30 (member forming the nail mount 30 (in the embodiment, first member 36)) downward with a finger or the like. Thus, the knock shaft 365 is lowered while pressing down the rotation member 363, resisting the forcing power of the first spring 356.

Thus, the locked state is released as mentioned above, and the fastening protrusions 363*c* become movable in the vertical direction. At this time, when the user releases the pressing with the finger or the like, the rotation member 363 and the first member 36 connected thereto are raised upward (Z direction) by the forcing power of the first spring 356. The entire nail mount 30 including the nail rest 372 rises, the nail rest 372 abuts the surface on the lower side of the medium mounting member 392, and presses the surface upward.

Figure 13B:
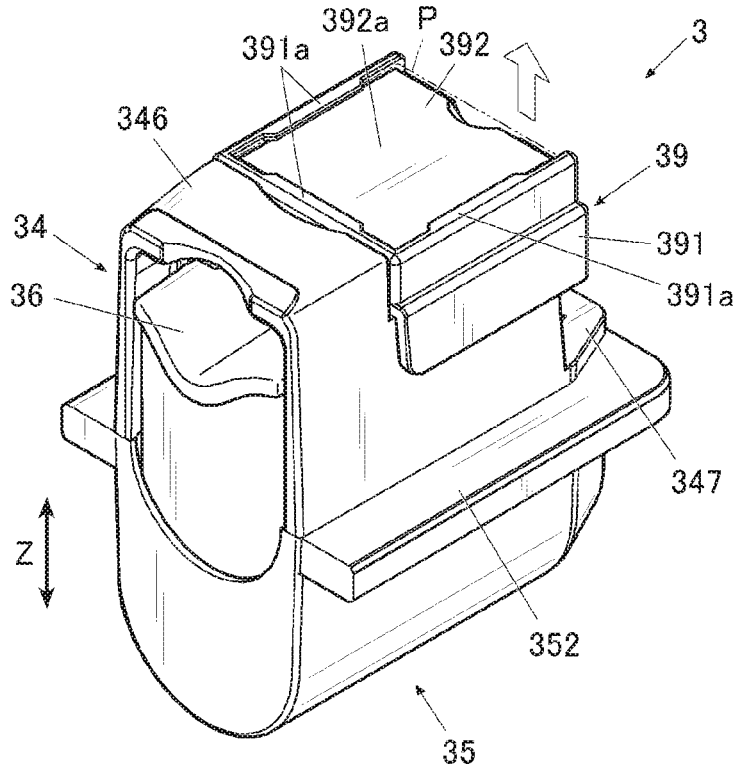
FIG. 13B is a perspective view of the target fixer in a positioned state in which the printing medium is positioned at a proper position.

When the medium mounting member 392 is pressed up to make the medium mounting surface 392*a* abut the projections 391*a* of the unit frame 391, as shown in FIG. 13B, the printing medium P is sandwiched and fixed between the medium mounting surface 392*a* and the projections 391*a* (medium positioning).

In this state, the surface of the printing medium P is held at the substantially same height as the height of the surface of the nail T when the nail T of the printing finger U1 is fixed in the nail mount 30, and the printing medium P can be positioned at the proper position appropriate for printing by the print head 41.

In such a way, in the embodiment, the device is in the positioned state in which the printing medium P which is the printing target is positioned at the proper position when the first spring 356 and the like which are the forcing members of the forcer 32 are in the state of forcing the nail mount 30.

When the printing processing to the printing medium P is finished and the printing medium P is removed, the user removes the target fixer 3 from the insertion port 18 and presses again the nail mount 30 (in the embodiment, first member 36 forming the nail mount 30) with the printing finger U1 downward, into the locked state to make the device in the initial set state (that is, state shown in FIG. 13A).

Thus, the nail mount 30 (nail rest 372 of the nail mount 30) is not forced toward the medium mounting unit 39 by the forcer 32.

In the embodiment, the device is in the released state in which the positioned state is released when the first spring 356 and the like which are the forcing members of the forcer 32 are not in the state of forcing the nail mount 30.

In this state, since a sufficient space between the medium mounting surface 392*a* and the projections 391*a* of the unit frame 391 is secured, the user can detach the printing medium P from the medium mounting unit 39.

In this state, it is also possible to detach the medium mounting unit 39 from the target fixer 3.

In such a way, in the embodiment, the nail mount 30 and the medium mounting member 392 are selectively used by attaching or detaching the medium mounting unit 39 as needed.

That is, in a case where printing is performed on the nail T of the printing finger U1, the device is in the state shown in FIG. 3A in which the medium mounting unit 39 is detached. In a case where printing is performed on the printing medium P such as a test printing sheet, as shown in FIGS. 13A and 13B, printing is performed in a state in which the medium mounting unit 39 is mounted on the upper surface of the upper case 34 to cover the window 345.

In a state in which the medium mounting unit 39 is mounted on the upper case 34, printing cannot be performed on the nail T since the window 345 to expose the nail T to the print head 41 is covered. Thus, whether to perform printing on the nail T or on the printing medium P is alternative and selective.

Though not shown in the drawings, a drawer or the like for containing small articles may be provided to the nail print device 1 so that the medium mounting unit 39 can be contained in the drawer when the printing is performed on the nail T. In this case, it is possible to contain the medium mounting unit 39 in a position not obstructive, and avoid the possibility of loss and damage.

As described above, according to the embodiment, a forcer (in the embodiment, formed of the first spring 356 and the second spring 358 which are the forcing members) is provided. The forcer 32 forces the mount on which the printing target is placed, and positions the nail T of the printing finger U1 placed on the mount as the printing target at the proper position appropriate for printing by the print head 41. The forcer 32 is configured to be able to also position the printing medium P at the proper position in a case where the printing medium P other than the nail T of the printing finger U1 is the printing target instead of the nail T of the printing finger U1.

Thus, even in a case where the printing medium P is the printing target, it is possible to position the printing medium P at the position appropriate for printing by using the forcer 32 for positioning the nail T at the proper position.

Thus, it is possible to perform printing on the various types of printing mediums P in addition to the nail T with a single nail print device 1, leading to a wide range of uses of the nail print device 1.

When the printing can be performed on the various types of printing targets in such a way, a common forcer 32 can be used both in a case where the printing is performed on the nail T and in a case where the printing is performed on the printing medium P other than the nail T. Thus, it is possible to simplify the device and reduce the size of the device.

As the means for positioning the printing target at the proper position, the forcing members (first spring 356 and the like) acting on the mount (in the embodiment, nail mount 30 and the medium mounting member 392) are used. Thus, even in a case where the printing target is various types of printing fingers U1 having different thicknesses and sizes and various types of printing mediums P having different thicknesses, it is possible to position the printing target at the proper position appropriate for the printing easily and appropriately, and treat various types of printing targets widely.

In the embodiment, the forcer 32 has forcing members (first spring 356 and the like) that act on the mount (in the embodiment, nail mount 30 and medium mounting member 392). The forcer 32 is in a positioned state in which the printing target is positioned at the proper position when the forcing members are in a state of forcing the mount, and the forcer is in a released state in which the positioned state is released when the forcing members are not in the state of forcing the mount.

Thus, it is possible to easily switch between the positioned state in which the printing target is positioned at the proper position and the released state in which the positioned state is released by whether to cause the forcer 32 to be in the forcing state.

Thus, it is possible to remove the printing target from the nail print device 1 with a simple configuration.

In the embodiment, the forcer 32 includes a locker that maintains the released state.

Thus, since the released state of the nail mount 30 and the medium mounting member 392 can be maintained by the locker, the user can easily remove the printing finger U1 and the nail T thereof or the printing medium P from the target fixer 3 without continuing the pressing of the member.

In the embodiment, the mount (in the embodiment, nail mount 30 and medium mounting member 392) and the forcer 32 are provided in a target fixer 3 that can be attached to and detached from a device main body.

Thus, it is possible to calmly set the nail T and the printing medium P in the state of being detached from the nail print device 1.

In the embodiment, as the mount, there are provided the nail mount 30 to place the printing finger U1 or the nail T in a case where the printing target is the nail T of the printing finger U1, and the medium mounting member 392 as the medium mount to place the printing medium P in a case where the printing target is the printing medium P. At least one of the nail mount 30 and the medium mounting member 392 can be attached and detached selectively according to the printing target.

Thus, it is possible to exchange the nail mount 30 and the medium mounting member 392 as an attachment while sharing the main body of the target fixer 3, and printing can be performed on the various types of printing targets by changing only a few members.

Though the embodiment of the present invention has been described above, the present invention is not limited to the embodiment, and various modifications can be made within the scope of the invention.

For example, though the embodiment has been described by taking, as an example, a case where the nail mount 30 of the target fixer 3 is formed of two members 36 and 37, the configuration of the nail mount 30 is not limited to this. For example, the nail mount 30 may be formed of three members or more, or formed of a single member.

The configuration of the forcer 32 is also not limited to the configuration illustrated in the embodiment. For example, in a case where the nail mount 30 is formed of three members or more, the forcing members (for examples, springs) corresponding to the respective members may be provided to form the forcer 32 with the three forcing members or more. In a case where the nail mount 30 is formed of a single member, the forcer 32 may be also formed of a single forcing member. Furthermore, the number of the members forming the nail mount 30 and the number of the forcing members forming the forcer 32 may not match each other. For example, even in a case where the nail mount 30 is formed of three members or more, the forcer 32 may be formed of a single forcing member.

The embodiment has been described by taking, as an example, a case where the mount to place the nail T of the printing finger U1 as the printing target (that is, nail mount 30) is incorporated into the main body of the target fixer 3, and the mount to place the printing medium P as the printing target (that is, medium mounting unit 39) can be attached to and detached from the main body of the target fixer 3. However, the configuration of the mount is not limited to this.

For example, the medium mounting unit 39 to place the printing medium P may be incorporated into the main body of the target fixer 3 so that the nail mount 30 to place the nail T of the printing finger U1 can be attached to and detached from the main body of the target fixer 3.

In the embodiment, there has been shown an example in which the nail mount 30 for nail T and the medium mounting unit 39 for medium P are provided as the mount in the target fixer 3. However, the mount is not limited to a case of having a single type of mount for each of the nail T and the printing medium P.

For example, a plurality of types of the medium mounting units 39 may be prepared according to the type of the printing medium P. In this case, it is possible to easily treat various printing mediums P by merely changing the medium mounting unit 39 to be attached to the main body of the target fixer 3. As the modification example of the medium mounting unit 39, for example, a concave portion may be provided to the medium mounting surface 392*a* so that a three-dimensional medium such as an artificial nail can be placed.

Even if a plurality of types of medium mounting units 39 is not prepared, a common unit frame 391 may be used and a plurality of types of medium mounting members 392 to be attached to the unit frame 391 may be prepared to be exchanged as needed according to the type of the printing medium P. In this case, even if a plurality of types of exchanging members is prepared, the members are not bulky since the members are small. For example, when a drawer or the like for containing small articles is provided to the nail print device 1, it is possible to easily contain the medium mounting member(s) 392 to be exchanged in the drawer or the like for containing the small articles.

In a case where the nail mount 30 is configured to be an attachable/detachable member, a plurality of types of nail mounts 30 may be prepared according to the thickness of the finger, the length of the nail, the curvature of the nail T and the like.

The embodiment has been described by taking, as an example, a case where the mount and the forcer 32 are provided to the target fixer 3 that can be detached from the main body of the nail print device 1. However, the mount and the forcer 32 may be provided to be fixed to the nail print device 1 not to be able to be detached.

In this case, it is possible to avoid deterioration, loss and the like of the members caused by repeated attachment and detachment of the members.

The forcer 32 is not limited to the configuration shown in the embodiment as long as it can force the mount and position the nail T of the printing finger U1 and the printing medium P other than the nail T of the printing finger U1 placed on the mount at a proper position appropriate for printing by the print head 41 as the printing target.

For example, the forcer 32 may not include the forcing members such as the springs, and may force the mount by pinching and swelling the gas, liquid or the like, to position the printing target at the proper position appropriate for printing.

The embodiment has been described by taking, as an example, a case where the user inputs what to place on the mount and to what the printing is performed. However, input by the user is not essential.

For example, what is positioned on the mount (that is, nail mount 30 and the medium mounting member 392) may be determined by the device from the image photographed with the imaging device 51 or the like so that the printer 40 is adjusted to perform printing according to the printing target automatically.

Furthermore, there may be provided a function of detecting that the printing targets (for example, nail T and printing medium P) are not placed on the mount at all, and notifying this to the user.

As the method of notification, there may be methods of causing the display 13 to display a message or the like, light a lamp or the like, and methods of notifying with sound, alarm or the like by providing a speaker or the like.

Determination regarding whether the printing target is placed on the mount or not is performed by the device from the image photographed by the imaging device 51, for example.

Furthermore, the notification may be performed similarly also in a case where it is detected that the object, which is different from the printing target input by the user in advance, is placed on the mount.

Though several embodiments of the present invention have been described above, the scope of the present invention is not limited to the above embodiments, and includes the scope of inventions, which is described in the scope of claims, and the scope equivalent thereof.

What is claimed is:

1. A printing device comprising:

a print head that performs printing on a printing target;

a mount on which the printing target is placed; and a lift that positions, as the printing target, a nail of a finger or a toe placed on the mount at a proper position appropriate for the printing by the print head by lifting the mount, and that positions, as the printing target, a printing medium other than the nail of the finger placed on the mount at a proper position appropriate for the printing by the print head by lifting the mount, wherein the mount includes a nail mount on which the finger or the nail is placed when the printing target is the nail of the finger and a medium mount on which the printing medium is placed when the printing target is the printing medium, and at least one of the nail mount and the medium mount is able to be attached and detached selectively according to the printing target.

2. The printing device according to claim 1, wherein the lift includes a forcing member that acts on the mount, and the lift is in a positioned state in which the printing target is positioned at the proper position when the forcing member is in a state of forcing the mount, and the lift is in a released state in which the positioned state is released when the forcing member is not in the state of forcing the mount.

3. The printing device according to claim 2, wherein the lift includes a locker that maintains the released state.

4. The printing device according to claim 1, wherein the mount and the lift are provided in a target fixer that is able to be attached to and detached from a device main body.

5. The printing device according to claim 1, wherein the mount includes a fixer that fixes the printing target when the lift is in a state of lifting the mount.

6. The printing device according to claim 1, wherein the nail mount includes a lift portion which contacts a bottom surface of the medium mount upon sufficient lifting of the nail mount by the lift.

7. The printing device according to claim 1, wherein a thickness of the printing medium is different from a thickness of the nail.

* * * * *